United States Patent [19]

Rowe et al.

[11] Patent Number: 4,484,834

[45] Date of Patent: Nov. 27, 1984

[54] PAVERS

[75] Inventors: Murray A. Rowe; Ewald R. Ulmer, both of Canton, S. Dak.

[73] Assignee: Bid-Well Corporation, Canton, S. Dak.

[21] Appl. No.: 419,970

[22] Filed: Oct. 27, 1982

[51] Int. Cl.[3] ..... E01C 19/40; E02D 5/00

[52] U.S. Cl. ..... 404/84; 404/96; 404/119; 405/268

[58] Field of Search ..... 404/96, 119, 120, 118, 404/105, 106, 101, 84; 405/268, 179; 409/347, 348, 303; 51/37

[56] References Cited

U.S. PATENT DOCUMENTS

| | | | |
|---|---|---|---|
| 2,090,959 | 8/1937 | Jackson | 404/96 X |
| 2,362,490 | 11/1944 | Lewis | 405/268 |
| 2,603,132 | 7/1952 | Miller et al. | 404/119 |
| 3,368,466 | 2/1968 | Rowe | 404/119 |

FOREIGN PATENT DOCUMENTS

| | | | |
|---|---|---|---|
| 577604 | 5/1933 | Fed. Rep. of Germany | 404/118 |
| 715695 | 2/1980 | U.S.S.R. | 405/268 |

*Primary Examiner*—Stephen J. Novosad
*Assistant Examiner*—Beverly E. Hjorth
*Attorney, Agent, or Firm*—Emrich & Dithmar

[57] ABSTRACT

A paver embodying a vibrating pan for spreading concrete and smoothing and compacting the same on a sloping surface is described.

10 Claims, 3 Drawing Figures

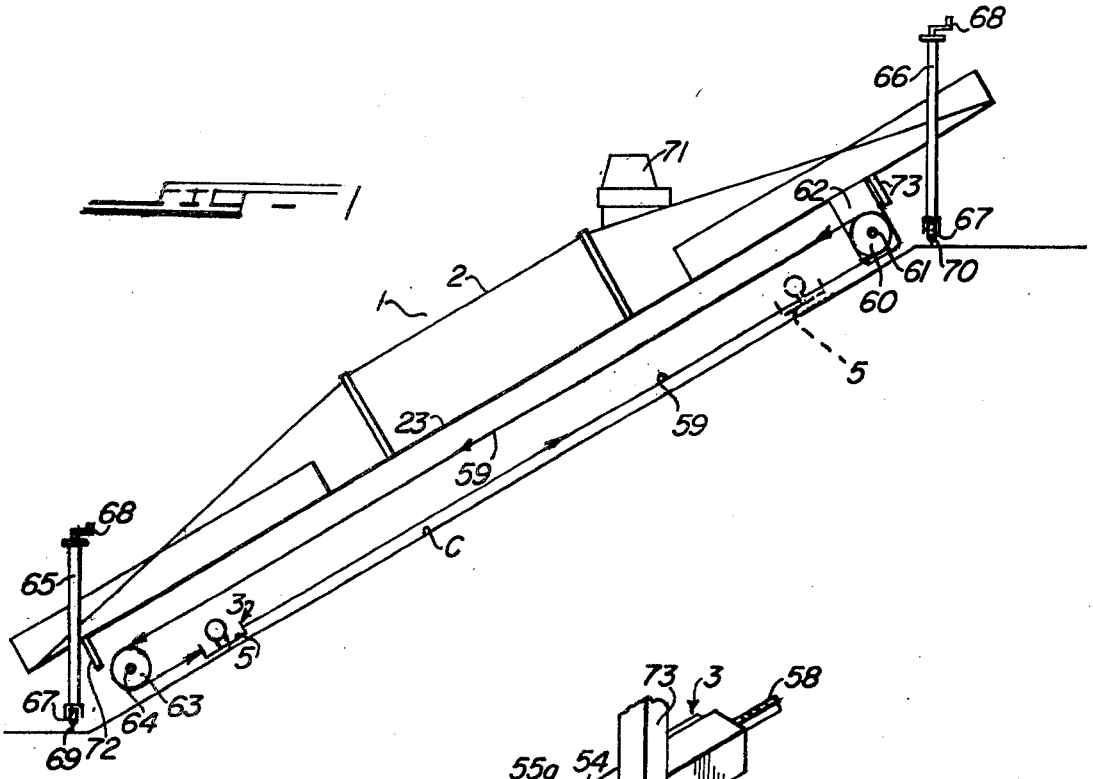
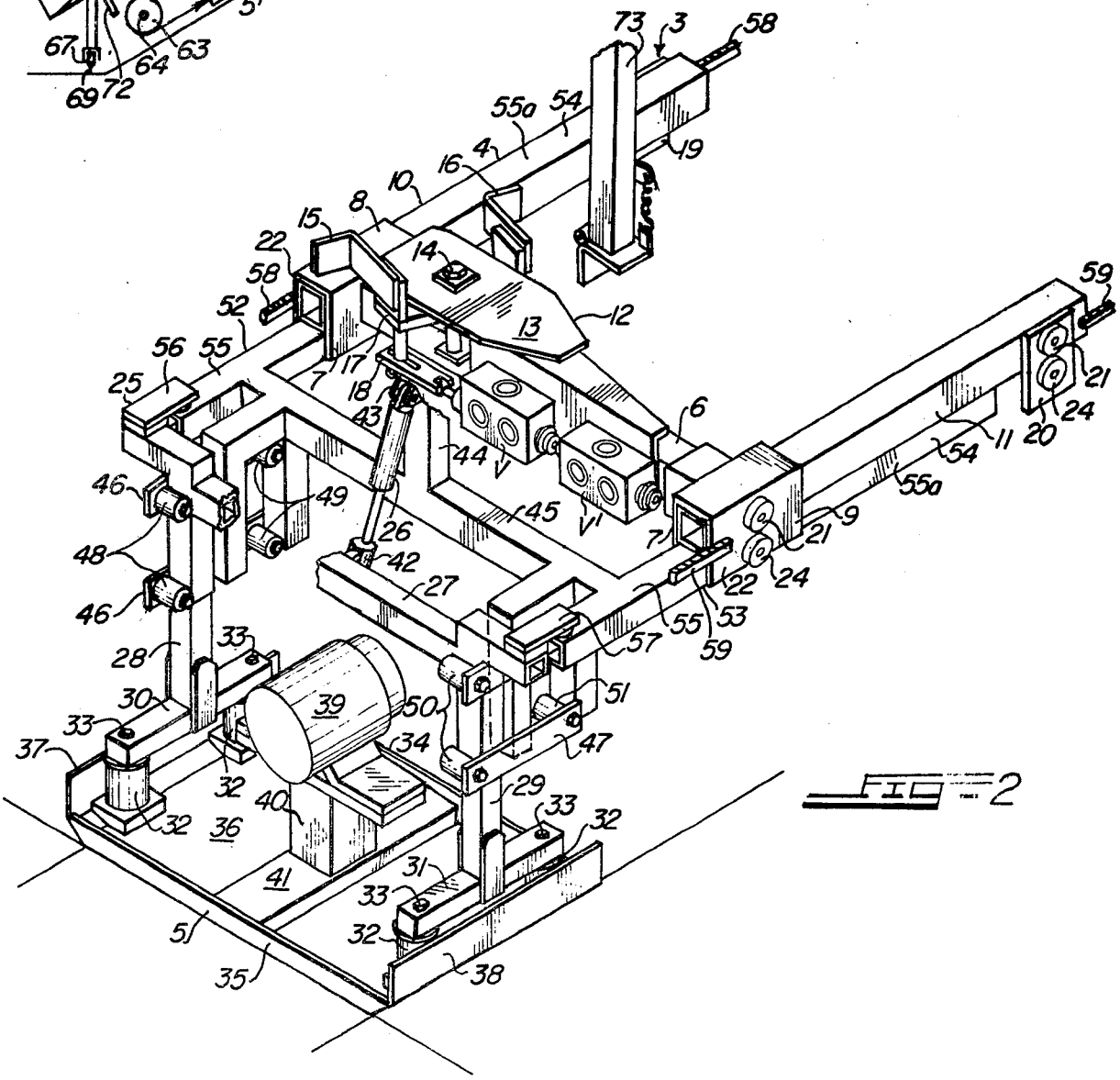
FIG. 2

3
58
54
55a
4
10
16
19
72
8
22
14
15
12
13
59
56
58
25
8
52
18
49
6
55
46
48
46
44
V
26
45
V'
22
42
57
9
21
24
28
33
49
30
39
59
53
55
33
50
34
37
32
51
40
47
33
32
36
29
41
33
38
5
32
35
31

PAVERS

BACKGROUND OF THE INVENTION

This invention relates to pavers, and, more particularly, to pavers of the type commonly known in the art as slope-pavers.

A primary object of the present invention is to afford a novel paver.

Another object of the present invention is to afford a novel paver which is well adapted for paving surfaces which slope upwardly at an appreciable angle, such as, for example, in the nature of forty-five degrees.

Slope-pavers have been heretofore known in the art. However, such pavers that have been known in the art, have had several inherent disadvantages, such as, for example, being complicated in construction and operation; not being reliable in operation; spreading the concrete in such a manner that it tends to slump downwardly along the surface being paved; not being effective to properly smooth and compact the concrete being laid; or being expensive in construction and operation, and the like. It is an important object of the present invention to overcome such disadvantages of slope-pavers heretofore known in the art.

Another object of the present invention is to afford a novel slope-paver which is effective to spread concrete on a sloping surface in a novel and expeditious manner.

Another object of the present invention is to afford a novel slope-paver which is effective not only to spread the concrete, but to effectively smooth and compact the same.

A further object of the present invention is to afford a novel slope-paver which embodies a vibrating pan constituted and arranged in a novel and expeditious manner for spreading, smoothing and compacting concrete on a sloping surface.

Another object of the present invention is to afford a novel slope-paver of the aforementioned type wherein the movement of the pan is so controlled that it spreads the concrete only during movement of the pan up the slope to be paved; the pan is lifted off from the concrete before moving back down along the slope so as to prevent concrete being dragged down the slope; the pan is not vibrated during movement thereof along the slope, in spaced relation thereto; and the pan is moved into spreading engagement with the concrete, and vibration thereof is commenced after the pan has again started to move up the slope.

Another object of the present invention is to afford a novel slope-paver which is practical and efficient in operation and which may be readily and economically produced commercially.

Other and further objects of the present invention will be apparent from the following description and claims and are illustrated in the accompanying drawings, which, by way of illustration, show a preferred embodiment of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

FIG. 1 is a somewhat diagrammatic illustration of a paver embodying the principles of the present invention, showing the paver disposed in position to perform paving operations on a slope;

FIG. 2 is a rear perspective view of the vibrating-pan mechanism embodied in the paver shown in FIG. 1, showing the pan thereof in lowered position.

DESCRIPTION OF THE EMBODIMENT

Figure 3:
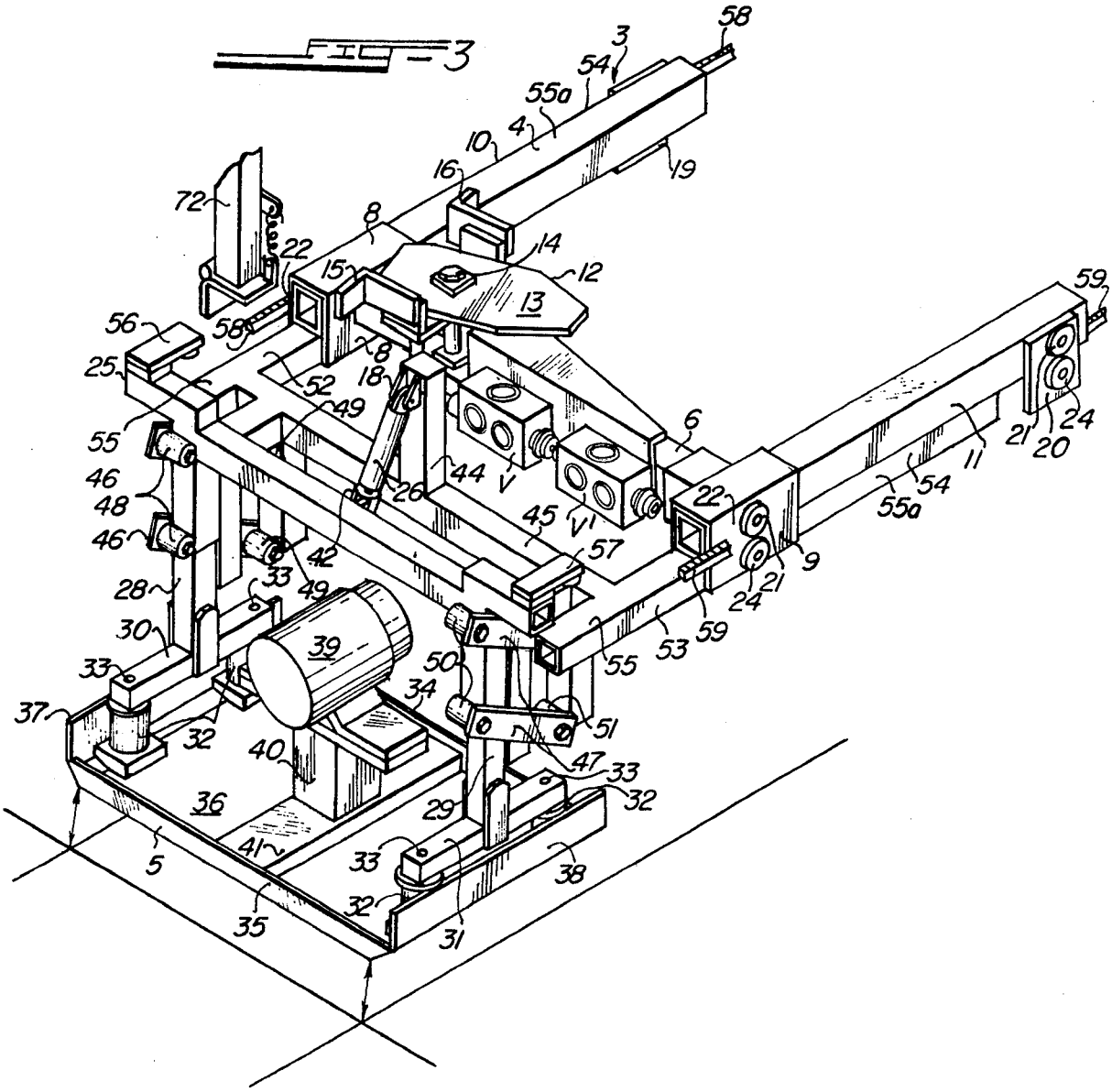
FIG. 3 is a rear perspective view of the mechanism shown in FIG. 1, but showing the pan thereof disposed in raised position.

A paver 1, embodying the principles of the present invention, is shown in the drawings to illustrate the present preferred embodiment of the present invention. The paver 1 embodies, in general, an elongated supporting frame or truss 2, shown somewhat diagrammatically in the FIG. 1, for spanning the surface to be paved, with a vibrating-pan mechanism 3, FIGS. 2–3, embodying a carriage 4 for supporting a pan 5 from the truss 1 for reciprocation longitudinally of the latter.

The truss 1 may be of any suitable type well known in the art, such as, for example, the type of truss shown in U.S. Letters Patent No. 3,392,641, issued July 16, 1968 to John E. Kessel.

The carriage 4, which affords also a supporting frame for the control mechanism of the vibrating-pan mechanism 3, as will be discussed in greater detail presently, embodies a cross bar 6 having its opposite ends secured to the inner walls 7 of inverted, substantially U-shaped channel members 8 and 9, respectively, by suitable means such as, for example, welding. The carriage 4 embodies two elongated, substantially straight side members 10 and 11 having their rear end portions mounted in and welded to the upper portions of the channel members 8 and 9, respectively, with the side members 10 and 11 projecting forwardly from the channel members 8 and 9 in substantially parallel relation to each other.

An over-center switching mechanism 12 is mounted on the cross bar 6 of the carriage 4 and is operatively connected to two hydraulic valves V and $V^1$ for the purpose which will be discussed in greater detail presently. The switching mechanism 12 embodies a plate 13 mounted on a rotatable post 14, projecting upwardly from the cross bar 6, for pivotal movement thereon between the positions shown in FIGS. 2 and 3, respectively. The switching mechanism 12 also embodies two actuators 15 and 16, by which the plate 13 may be pushed to the positions shown in FIGS. 2 and 3, respectively, and a lever arm 17 connected by a connector 18 to the hydraulic valves V and $V^1$, for actuating the latter during the aforementioned pivotal movement of the plate 13.

The carriage 4 also embodies two mounting members 19 and 20, mounted on the front end portions of the outer sides of the side members 10 and 11, respectively, with four wheels 21, two of which are shown in FIGS. 2 and 3, mounted on the outer faces of the outer sides 22 of the channel members 8 and 9 and the outer faces of the mounting members 19 and 20, respectively. Each of the wheels 21 has a groove extending around the periphery thereof.

The wheels 21, on each side of the carriage 4, in the assembled paver 1, are mounted on oppositely disposed side rails, such as the side rail 23 shown in FIG. 1, of the truss 1 for rotation along the oppositely disposed side rails 23 in a manner well known in the art. Also, the carriage 4 embodies four hold-down wheels 24, two of which are shown in FIGS. 2 and 3, mounted on the channel members 8 and 9 and the mounting members 19 and 20, respectively, immediately below respective ones of the wheels 21, in position to engage the lower faces of the rails 23 on which the immediately adjacent wheels 21 are disposed to insure that the carriage 4 is retained on the rails 23 during movement therealong.

The vibrating-pan mechanism 3 includes an auxiliary frame 25 for supporting the pan 5, the frame 25 and, therefore, the pan 5 being raised and lowered by a hydraulic cylinder 26, during operation of the paver 1, to dispose the pan 5 in raised position relative to the concrete, as shown in broken lines in FIG. 1, and in lowered, concrete-engaging position as shown in solid lines in FIG. 1, as will be discussed in greater detail presently.

The frame 25 embodies an upper, substantially horizontally extending cross-bar 27, from the opposite end portions of which depend two legs 28 and 29, respectively. Two cross-bars 30 and 31 are secured to the lower ends of the legs 28 and 29, respectively, in substantially parallel, spaced relation to each other, the legs 28 and 29 extending along the direction of travel of the mechanism 3 during a paving operation.

Preferably, the connection of the pan 5 to the frame 25 is effected through resilient connecting mechanism which is effective to isolate vibrations of the pan 5 from the supporting frame 25, for a purpose which will hereinafter be discussed in greater detail. In the paver 1 shown in the drawings, such connection of the pan 5 to the frame 25 is effected through suitable resilient cushions or mounts in the form of rubber tubular members 32, FIGS. 2 and 3, secured to respective ends of the cross-bars 30 and 31 by bolts 33, extending downwardly through the cross bars 30 and 31 into the upper ends of the cushions 32. The pan 5 is similarly connected to the cushions 32 by bolts, not shown, the latter bolts extending upwardly through the pan 5 into the bottoms of respective ones of the cushions 32. With this construction, the pan 5 is yieldingly suspended from the supporting frame 25 through the rubber tubular members 32.

The pan 5, preferably, is substantially rectangular in shape, the length thereof extending transversely to the movement thereof along the concrete, during movement of the mechanism 3 along the truss 2, with the pan 5 preferably embodying flanges 34 and 35 extending along, and projecting upwardly from the front and rear edges of the bottom 36 thereof, respectively, and with flanges 37 and 38 extending along and projecting upwardly from respective lateral sides of the bottom 36, FIGS. 2 and 3.

A hydraulic vibrator 39 is mounted on top of a block or pedestal 40, which rests on a crossbeam 41, which is disposed on and extends laterally across the top face of the bottom 36 of the pan 5 midway between the flanges 37 and 38, FIGS. 2 and 3. The vibrator 39 is connected through suitable hydaulic lines, not shown, to the hydraulic valve V, which, in turn, is connected through suitable hydraulic lines to a suitable source of hydraulic fluid, including a hydraulic pump, not shown, carried by the truss 2. As will be discussed in greater detail presently, during a paving operation, when the pan 5 is moving along the concrete to be worked, such as during movement thereof from left to right, as viewed in FIG. 1, the over-center switching mechanism 12 is disposed in the position shown in FIG. 2. In this position of the switching mechanism 12, it is effective through the connector 18, to hold the hydraulic valve V in position wherein it is effective to feed hydraulic fluid into the cylinder 26 in a direction effective to hold the pan 5 in lowered, concrete-engaging position, as will be discussed in greater detail presently.

In addition to the hydraulic cylinder 26, which is connected at its lower end to the cross-bar 27 by a coupling member 42, and is connected at its upper end by a connecting member 43 to a leg 44, projecting upwardly from a cross-bar 45 of the carriage 4, disposed rearwardly of, and in substantially parallel relation to the cross-bar 6, FIGS. 2 and 3, the auxiliary frame 25 is pivotally connected to the carriage 4 by two pairs of links 46 and 47, disposed outwardly of the legs 28 and 29 of the frame 25, respectively. One end of each of the links 46 is pivotally connected to a respective hanger 48, mounted on the leg 28 of the frame 25, and the other end of each of the respective links 46 is connected to a respective hanger 49 mounted on the carriage 4, FIGS. 2 and 3. Similarly, one end of each of the links 47 is pivotally connected to a respective hanger 50 on the leg 29 of the frame 25, and the other end of each of the links 47 is connected to a respective hanger 51, one of which is shown in FIGS. 2 and 3, on the carriage 4.

Two side members 52 and 53 are mounted on and project forwardly and rearwardly from respective opposite ends of the cross-bar 45 of the carriage 4, the intermediate portions 54 of the side members 52 and 53 being disposed in and connected to the lower portions of the channel members 8 and 9, in underlying relation to the side members 10 and 11, respectively, and the rear end portions 55 of the side members 52 and 53 projecting rearwardly from the cross-bar 45 toward the auxiliary frame 25.

The frame 25 has two flanges 56 and 57 mounted on, and projecting rearwardly from the upper ends of the legs 28 and 29 thereof, respectively, in overlying relation to the front end portions 55 of the side members 52 and 53 of the carriage 44. The flanges 56 and 57 are so disposed on the frame 25, that, when the latter is disposed in lowered position, as shown in FIG. 2, the flanges 56 and 57 rest on top of the front end portions 55 of the side members 52 and 53, respectively, to limit the downward movement of the pan 5 into the concrete being worked; and, when the frame 25 is disposed in raised position, as shown in FIG. 3, the flanges 56 and 57 are disposed in upwardly spaced relation to the front end portions 55*a* of the side members 52 and 53.

Movement of the frame 25 and the pan 5 from the aforementioned lowered position, shown in FIG. 2, to the aforementioned raised position, shown in FIG. 3, is effected through the hydraulic cylinder 26, the latter being effective, upon appropriate actuation of the hydraulic valve V, to swing the frame 25 on the links 46 and 47 upwardly around the pivotal connection of the links 46 and 47 to the carriage 4, into the aforementioned raised position shown in FIG. 3. Actuation of the valve V in the other direction is effective to release the hydraulic pressure from the cylinder 26, which was effective to raise the frame 25, to thereby permit the weight of the frame 25 and the apparatus and structure attached thereto, including the vibrator 39, to cause the frame 25 to move downwardly into the aforementioned lower position, where the flanges 56 and 57 again rest on the front end portions 55 of the side members 52 and 53.

Two chains 58 and 59 are secured to respective ends of the side members 10 and 11 of the carriage 4, by suitable means, such as, for example, by welding. As may be seen in FIGS. 2 and 3, one end of each of the chains 58 and 59 is secured to the front of the side members 10 and 11, respectively, and the other ends of the chains 58 and 59 are secured to the outer walls 22 of the inverted channel members 8 and 9 disposed at the rear ends of the side members 10 and 11 of the carriage 4.

At the right end of the paver 1, as viewed in FIG. 1, the chains 58 and 59 are trained over two respective sprocket wheels 60, only one of which is shown in FIG. 1, which are mounted on opposite ends of a drive shaft 61 having a suitable drive unit 62 mounted on the outer end of the truss 2. In the drawings, the drive unit 62 is shown as being a hydraulic motor, with the drive shaft 61 being the drive shaft of the motor. However, as will be appreciated by those skilled in the art, if desired, a suitable reduction gear unit may be interposed between the motor 62 and the drive shaft 61.

At the other end of the paver 1, the chains 58 and 59 are trained over two respective sprocket wheels 63 only one of which is shown in FIG. 1, rotatably mounted on a shaft 64 in radial alignment with respective ones of the sprocket wheels 60. The sprocket wheels 63 comprise idler wheels around which the chains 58 and 59 are driven by the motor 62. If desired, the sprocket wheel unit 63 and the sprocket wheel unit 60, with the motor 62, may be adjustably mounted on the truss 2 for movement toward and away from each other by suitable means not shown, which are well known in the art, for adjusting the tension of the chains 58 and 59. Preferably, additional idler sprocket wheels, not shown, are mounted on the truss 2, by suitable means heretofore known in the art, in position to support the upper passes of the chains 58 and 59 in upwardly spaced relation to the carriage 4 between the sprocket wheels 60 and the sprocket wheels 63.

With the paver 1 constructed in the aforementioned manner, reversal of the operation of the hydraulic motor 62 is effective to pull the carriage 4 in opposite directions along the truss 2, so that the vibrating-pan mechanism 3 may be readily reciprocated across the concrete surface to be worked, such as the surface C. In the paver 1, such reversal of the motor 62 is accomplished through the valve $V^1$, which is connected by suitable hoses, not shown, to the aforementioned source of hydraulic fluid, not shown, and to the motor 62. Disposal of the plate 13 in the position shown in FIG. 2 is effective to actuate the valve $V^1$ in such a manner as to drive the motor 62 in a direction to rotate the sprocket wheels 60 in a counter-clockwise direction, as viewed in FIG. 1, to thereby advance the vibrating-pan mechanism 3 upwardly along the slope to be paved, toward the legs 66 on the truss 2. Actuation of the plate 13 to its other operative position, as shown in FIG. 3, is effective to disposed the valve $V^1$ in position to cause the motor 62 to be driven in the opposite direction to rotate the sprocket wheels 60 in a clockwise direction, as viewed in FIG. 1, to thereby move the mechanism 3 downwardly along the slope to be paved, toward the legs 65 on the truss 2.

The truss 2 has two leg-type supporting units 65 and 66, of a type well known in the art, such as, for example, the type shown in the aforementioned Kessel U.S. Pat. No. 3,392,641, each embodying wheel units 67 rotatably mounted on the lower end portions thereof with the units 65 and 66 being vertically adjustable relative to the wheels 67 by suitable means such as hand cranks 68 to thereby raise and lower the truss 2 relative to the wheels 67, for adjusting the proper height of the vibrating-pan mechanism 3 relative to the surface to be paved.

In the drawings, the wheels 67 on the truss 2 are shown mounted on the upper edges of two side rails 69 and 70 disposed at opposite sides of the surface, such as the surface C, to be worked, in outwardly spaced relation to the latter. In the operation of the paver 1, of course, it is intermittently moved along the rails 69 by power means, not shown, under the control of an operator riding thereon in proper position, such as, for example, at a control console 71.

In the operation of the paver 1, the rails 69 and 70 first would be placed in position on opposite sides of the surface to be paved. Thereafter, the paver 1 may be moved into operative position wherein the wheels 67 on the legs 65 and 66 rest on the rails 69 and 70 in position to support the paver 1 in spanning relation to the surface to be paved. Thereafter, the cranks 68 on the legs 65 and 66 may be manipulated to dispose the truss 2 in the desired position above the surface to be paved. The paver 1 is adapted to perform so called slope-paving operations on sloping surfaces, such as, for example, the sides of irrigation canals or drainage canals, and the like, and, in FIG. 1, the leg 66 is disposed a considerable distance above the leg 65, with the body portion of the truss 2 extending upwardly at an acute angle from the leg 65 to the leg 66 in parallel relation to the surface to be paved. As will be appreciated by those skilled in the art, the angle of such surfaces commonly is of substantial magnitude, such as, for example, in the nature of forty-five degrees.

Concrete to be spread on a surface, such as the side of a canal or the like, is normally dumped thereon in piles or heaps. In the operation of the paver 1, after concrete has thus been disposed on the slope, shown in FIG. 1, the paver 1, with the pan 5 disposed in raised position as shown in FIG. 3 and in broken lines in FIG. 1, may be advanced forwardly along the rails 69 and 70, in a direction away from the view of FIG. 1, into position wherein the major portion of the pan 5 extends across the thus dumped concrete.

Thereafter, the motor 62 may be energized to thereby move the vibrating-pan mechanism 3 to the left, as viewed in FIG. 1, it will be remembered that during the positioning of the machine 1 over the dumped concrete, the pan 5 was disposed in raised position, which means that the plate 13 was disposed in the position shown in FIG. 3. As the vibrating-pan mechanism nears the lower end of its movement downwardly along the truss 2, the actuating member 15 engages an abutment member, such as a post 72 depending from the truss 2 to thereby move the plate 12 from the position shown in FIG. 3 to the position shown in FIG. 2. This, it will be remembered, is effective to actuate valve V into position to cause the hydraulic fluid to flow out of the cylinder 26 and thereby permit the frame 25 with the pan 5 connected thereto to be lowered. Also, this new positioning of the plate 12 is effective to actuate the valve $V^1$ to reverse the motor 62 and thereby cause the mechanism 3 to move upwardly, to the right, as viewed in FIG. 1.

The timing of the actuation of the valves V and $V^1$ is such that the pan 5 is not lowered into engagement with the concrete to be spread until the mechanism 3 is again moving upwardly to the right, as viewed in FIG. 1. It will be remembered that the valve V, which controls the raising and lowering of the mechanism 3, also is effective to control the operation of the vibrator 39, the vibrator 39 being inoperative when the pan 5 is disposed in raised position, and operative when the plate 13 is actuated to the position shown in FIG. 2, to thereby lower the pan 5 into engagement with the concrete.

With the pan 5 thus disposed in lowered position, it is pulled upwardly along the slope to be paved by the lower passes of the chains 58 and 59. During this movement, the flange 34 on the front edge of the pan 5 is effective to displace that portion of the pile of concrete against which it moves, forwardly around the left end of the pan 5 on which the flange 37 is disposed, while it spreads and smooths off the concrete disposed below the pan 5. With the vibrator 39 being actuated during such movement of the pan 5, the pan 5 is vibrated in a vertical direction to thereby afford a compacting and consolidating action on the concrete across which it passes. With this construction and mode of operation, the pan 5 is not only effective to initially spread and smooth the concrete across which it passes, but to afford a troweling and floating action thereon, as well as a vibration thereof, so that the concrete thus spread by the paver 1 is effectively consolidated and smoothed.

At the end of the upward movement of the mechanism 3 along the truss 2, the actuator 16 on the plate 13 engages an actuating member, such as a post 73, depending from the truss 2, to thereby turn the plate 13 and the post 14 from the position shown in FIG. 2 to the position shown in FIG. 3 to thereby actuate the valves V and $V^1$. Such an actuation of the valve V is effective to cause the hydraulic cylinder 26 to raise the pan 5 upwardly into raised position, as shown in FIG. 3, and to de-energize the vibrator 39. Such actuation of the hydraulic valve $V^1$ is effective to reverse the direction of rotation of the motor 62 to thereby cause the lower pass of the chains 58 and 59 to move downwardly to the left as viewed in FIG. 2, and thereby move the mechanism 3, with the pan 5 disposed in upwardly spaced relation to the concrete C, downwardly along the slope to be paved. The timing of the actuation of the valve V is such that the pan 5 is raised from the concrete being spread, and the vibrator 39 is turned off while the mechanism is still moving upwardly toward the leg 66. The posts 72 and 73 are adjustable along the truss 2 into any desired position and are secured to the frame of the truss 2 by any suitable connecting mechanisms, such as clamps, not shown.

With the pan 5 disposed in the aforementioned raised position, the operator may move the paver 1 forwardly along the rails 69 and 70 into position to again dispose a major portion of the pan 5 over unspread concrete, and the just described operation may again be performed upon the new concrete in the path of travel of the pan 5.

From the foregoing it will be seen that the present invention affords a novel paver, which is particularly well adapted for paving sloping surfaces, such as, for example, the sloping sides of irrigation canals and drainage canals, and the like.

In addition, it will be seen that the present invention affords a novel paver of the aforementioned type, which is practical and efficient in operation and which may be readily and economically produced commercially.

Thus, while we have illustrated and described the preferred embodiment of our invention, it is to be understood that this is capable of variation and modification, and we therefore do not wish to be limited to the precise details set forth, but desire to avail ourselves of such changes and alterations as fall within the purview of the following claims.

I claim:

1. A paver for paving a sloping surface comprising an elongated supporting means for extending longitudinally across the lateral width of such a sloping surface and movable laterally along the length of said sloping surface a pan for engaging concrete disposed on said sloping surface other means supporting said pan from said elongated supporting means for reciprocation travel along said supporting means upwardly and downwardly along said sloping surface, power means connected to said other means for reciprocating the latter and said pan along said elongated supporting means, control means on said other means for reversing the operation of said power means at each end of the path of travel of said other means and said pan along said elongated supporting means and thereby cause said other means and said pan to reverse their direction of travel along said elongated supporting means, means on said other means for lowering said pan into position to spread and smooth concrete on said sloping surace at the start of movement of said pan along said path of travel upwardly of said sloping surface, and, raising said pan from engagement with said concrete at the end of said path of travel upwardly of said sloping surface, and maintaining said pan in said raised position during movement of the latter along said path of travel downwardly of said sloping surface, and vibrator means connected to said pan for vertically vibrating said pan to thereby compact concrete beneath said pan during said movement of said pan upwardly of said sloping surface.

2. A paver as defined in claim 1 and in which said vibrator means is connected to said means for lowering and raising, whereby said vibrator is energized when said pan is disposed in said lowered position, and said vibrator is de-energized when said pan is disposed in raised position.

3. A paver as defined in claim 1 and which includes abutment means mounted on said elongated supporting means at each end of said path of travel for engaging said control means and actuating said control means to thereby effect said reversing of the operation of said power means.

4. A paver as defined in claim 3, and in which said means for lowering and raising said pan and said vibrator means are connected to said control means for simultaneous actuation therewith.

5. A paver for paving an elongated, laterally sloping surface disposed between two longitudinally extending rails, said paver comprising elongated truss means adapted to extend across said surface transversely to the length thereof, wheels on said truss means for supporting said truss means on said rails for movement longitudinally of said surface, means supported by said truss means for spreading concrete transversely across said surface, said concrete spreading means comprising a carriage mounted on said truss means for movement longitudinally of the latter, a pan suspended from said carriage for spreading concrete transversely across said surface during movement of said carriage longitudinally of said truss means, and means for moving said carriage longitudinally of said truss means, other means mounted on said carriage for lowering said pan into concrete-engaging position and raising said pan into position above such concrete during movement of said carriage longitudinally of said truss means, vibrator means connected to said pan for vibrating the latter and thereby compacting such concrete disposed therebelow during movement of said carriage longitudinally of said truss means with said pan disposed in said lowered position, and means for controlling said other means to thereby dispose said pan in said lowered position during movement of said carriage longitudinally of said truss means upwardly along said slope, and dispose said pan in said raised position during movement of said carriage longitudinally of said truss means downwardly along said slope.

6. A paver as defined in claim 5, and in which said means for controlling is operatively connected to said vibrator means for energizing said vibrator means when said pan is disposed in said lowered position, and de-energizing said vibrator means when said pan is disposed in said raised position.

7. A paver as defined in claim 5, and in which said means for controlling comprises switching meohanism mounted on said carriage and movable therewith, valve means mounted on said carriage and operatively connected to said switching mechanism and said other means for actuating said other means for lowering said pan when said switching mechanism is disposed in one position, and raising said pan when said switching mechanism is disposed in another position, and means on said truss means for engaging said switching mechanism and moving the latter into said other position when said carriage approaches the end of its travel along said truss means upwardly along said slope, and moving said switching mechanism into said one position when said carriage approaches the end of its travel along said truss means downwardly along said slope.

8. A paver as defined in claim 7, and in which said means for engaging said switching mechanism comprises two abutment members adjustably mounted on respective opposite end portions of said truss for adjustment toward and away from each other.

9. A paver as defined in claim 7, and in which said means for moving said carriage comprises a hyrdraulic motor mounted on said truss means, and said means for controlling includes another valve means mounted on said carriage and operatively connected to said switching mechanism and said motor for causing said motor to operate in one direction effective to move said carriage upwardly along said slope when said switching mechanism is disposed in said one position, and in another direction effective to move said carriage downwardly along said slope when said switching mechanism is disposed in said other position.

10. A paver as defined in claim 9, and in which said other means comprises a frame supporting said pan and pivotally mounted on said carriage for movement between raised and lowered positions, and a hydraulic cylinder connected between said frame and said carriage for moving said frame upwardly and downwardly, said first mentioned valve means is operatively connected to said hydraulic cylinder for controlling actuation of the latter, said frame includes abutment means disposed in position to engage said carriage and limit downward movement of said frame relative thereto when said pan is disposed in fully lowered position.

* * * * *